US007582145B2

(12) United States Patent
Krigmont

(10) Patent No.: US 7,582,145 B2
(45) **Date of Patent: *Sep. 1, 2009**

(54) SPACE EFFICIENT HYBRID COLLECTOR

(76) Inventor: Henry V. Krigmont, 3600 Marigold St., Seal Beach, CA (US) 90740

( * ) Notice: Subject to any disclaimer, the term of this patent is extended or adjusted under 35 U.S.C. 154(b) by 0 days.

This patent is subject to a terminal disclaimer.

(21) Appl. No.: 12/002,505

(22) Filed: Dec. 17, 2007

(65) Prior Publication Data

US 2009/0151568 A1 Jun. 18, 2009

(51) Int. Cl.
*B03C 3/06* (2006.01)

(52) U.S. Cl. ..... 96/66; 55/DIG. 38; 96/69; 96/97; 96/98; 96/99

(58) Field of Classification Search ..... 96/66, 96/69, 95–100; 55/DIG. 38
See application file for complete search history.

(56) References Cited

U.S. PATENT DOCUMENTS

| | | | | | |
|---|---|---|---|---|---|
| 1,345,790 | A | | 7/1920 | Lodge | 96/62 |
| 1,356,462 | A | | 10/1920 | Nesbit | 96/87 |
| 1,605,648 | A | * | 11/1926 | Cooke | 95/79 |
| 2,654,438 | A | | 10/1953 | Wintermute | 96/62 |
| 3,248,857 | A | | 5/1966 | Weindel et al. | |
| 3,440,800 | A | * | 4/1969 | Messen-Jaschin | 96/52 |
| 3,785,125 | A | | 1/1974 | DeSeversky | |
| 3,803,808 | A | | 4/1974 | Shibuya et al. | 96/54 |
| 3,818,678 | A | * | 6/1974 | Gothard | 95/75 |

(Continued)

FOREIGN PATENT DOCUMENTS

| | | | | |
|---|---|---|---|---|
| GB | 2016305 | A * | 9/1979 | 96/96 |

(Continued)

OTHER PUBLICATIONS

Pending U.S. Appl. No. 11/977,119, filed Oct. 23, 2007.

(Continued)

*Primary Examiner*—Richard L Chiesa
(74) *Attorney, Agent, or Firm*—Clifford Kraft

(57) ABSTRACT

A compact, hybrid particulate and gas collector that can be used in a vehicle emissions control system, gas turbine, or in any other application where space and lower cost is important or in applications where sub-micron and nano-particulate filtering is needed. A gas flow enters the device in a first chamber and can be immediately exposed to a high-tension corona discharge electric field which typically results in a strong ionic flow by charging and collecting the incoming effluent (oil mist, soot particles, etc.). Subsequently, the charged flow enters a second zone of high-tension uniform electric field that causes the remaining charged particles to migrate to one of the charged electrodes. One of the electrodes can be made of porous filter material that allows the cleaned gas to flow into an exit zone also containing a high-tension uniform electric field where the remaining effluent can be collected prior to the clean gas exiting either to ambient air or being re-circulated to be used again by the engine. In some embodiments a dielectric barrier discharge surface can be provided to convert harmful compounds to more desirable substances. Alternate embodiments can include a third zone containing a second substantially uniform electric field as well as coating the porous surface with a catalyst to convert undesirable compounds. Any cross-section may be used.

12 Claims, 8 Drawing Sheets

U.S. PATENT DOCUMENTS 3,839,185 A * 10/1974 Vicard ..... 204/665
3,915,676 A 10/1975 Reed et al. ..... 55/432 X
4,124,359 A 11/1978 Geller ..... 55/130
4,147,522 A 4/1979 Gonas et al. ..... 55/467 X
4,203,948 A 5/1980 Brundbjerg ..... 422/121
4,354,858 A 10/1982 Kumar et al. ..... 55/DIG. 5
4,357,151 A 11/1982 Helfritch et al. ..... 55/302 X
4,375,364 A 3/1983 Van Hoesen et al. ..... 96/87
4,411,674 A 10/1983 Forgac ..... 55/304
4,505,795 A 3/1985 Alamaro ..... 204/179
4,657,738 A 4/1987 Kanter et al. ..... 422/186.04
4,695,358 A 9/1987 Mizuno et al. ..... 204/174
4,874,586 A 10/1989 Szymanski et al. ..... 55/380 X
4,904,283 A 2/1990 Hovis et al. ..... 96/66
5,024,681 A 6/1991 Chang ..... 95/70
5,024,685 A * 6/1991 Torok et al. ..... 96/43
5,066,313 A 11/1991 Mallory, Sr. ..... 95/57
5,154,733 A 10/1992 Fujii et al. ..... 95/57
5,158,580 A 10/1992 Chang ..... 95/70
5,173,098 A 12/1992 Pipkorn ..... 55/379
5,185,015 A * 2/1993 Searle ..... 96/16
5,217,511 A 6/1993 Plaks et al. ..... 55/334 X
5,300,270 A 4/1994 Krigmont et al. ..... 423/239
5,433,772 A 7/1995 Sikora ..... 96/87
5,527,569 A 6/1996 Hobson et al. ..... 55/382 X
5,531,798 A 7/1996 Engstrom et al. ..... 248/77
5,547,493 A 8/1996 Krigmont ..... 96/54
5,547,496 A 8/1996 Hara ..... 96/79
5,582,632 A 12/1996 Nohr et al. ..... 95/78
5,601,791 A 2/1997 Plaks et al. ..... 422/169
5,695,549 A * 12/1997 Feldman et al. ..... 96/55
5,733,360 A * 3/1998 Feldman et al. ..... 95/78
5,938,818 A 8/1999 Miller ..... 95/63
5,944,857 A 8/1999 Edwards et al. ..... 29/25.01
5,993,738 A 11/1999 Goswani ..... 422/22
6,149,717 A 11/2000 Satyapal
6,152,988 A 11/2000 Plaks et al. ..... 95/58
6,193,782 B1 2/2001 Ray ..... 95/4
6,221,136 B1 * 4/2001 Liu et al. ..... 96/66
6,245,299 B1 * 6/2001 Shiloh et al. ..... 422/121
6,247,301 B1 6/2001 Brannstrom et al. ..... 60/39.12
6,294,003 B1 9/2001 Ray ..... 96/49
6,340,379 B1 1/2002 Penth et al. ..... 95/45
6,429,165 B1 8/2002 Nastke et al. ..... 55/524 X
6,482,371 B1 11/2002 Rasmussen ..... 423/1
6,482,373 B1 11/2002 Hannaford et al. ..... 423/47
6,514,315 B1 2/2003 Chang ..... 95/70
6,517,786 B1 2/2003 Best et al. ..... 422/186.04
6,524,369 B1 2/2003 Krigmont ..... 95/78
6,527,843 B1 3/2003 Zaima ..... 55/524 X
6,544,317 B2 4/2003 Miller ..... 95/83
6,585,809 B1 7/2003 Parsa ..... 96/16
6,623,544 B1 9/2003 Kaura ..... 95/3
6,660,061 B2 * 12/2003 Josephson et al. ..... 95/2
6,869,467 B2 * 3/2005 Scheuch ..... 96/55
6,926,758 B2 * 8/2005 Truce ..... 95/78
6,932,857 B1 8/2005 Krigmont ..... 95/63
7,105,041 B2 * 9/2006 Dunn ..... 96/66
7,112,236 B2 * 9/2006 Hoverson et al. ..... 95/78
7,264,658 B1 * 9/2007 Heckel et al. ..... 96/62
7,267,712 B2 9/2007 Chang et al. ..... 96/77
7,270,692 B2 9/2007 Gillingham et al. ..... 55/486
7,300,499 B1 11/2007 Fleisher ..... 96/16
7,332,020 B2 2/2008 Tanaka et al. ..... 96/66
2003/0177901 A1 * 9/2003 Krigmont ..... 95/78
2004/0025690 A1 * 2/2004 Krigmont ..... 95/78
2006/0254423 A1 11/2006 Tanaka et al. ..... 96/66
2006/0278082 A1 * 12/2006 Tomimatsu et al. ..... 96/66
2007/0068387 A1 3/2007 Pletcher et al. ..... 96/83
2007/0157814 A1 * 7/2007 Kim et al. ..... 96/61
2007/0283810 A1 12/2007 Besi ..... 96/64
2008/0092736 A1 4/2008 Krigmont et al. ..... 95/78

FOREIGN PATENT DOCUMENTS

JP 5-96 125 A 4/1993
JP 5-96125 A 4/1993

OTHER PUBLICATIONS

Pending U.S. Appl. No. 12/009,374, filed Jan. 19, 2008.

* cited by examiner

SPACE EFFICIENT HYBRID COLLECTOR

BACKGROUND

1. Field of the Invention

The present invention relates generally to the field of particulate and gas collectors and more particularly to a space efficient, hybrid collector incorporating electrostatic collectors and precipitators as well as particulate filters. The present invention is particularly attractive for exhaust after-treatment for vehicles, gas turbines and also applications such as high-tech, surgical and others that require the capture of sub-micron particles in both intake and exhaust air. Worldwide interest in gas turbine emissions and the enactment of Federal and State regulations in the United States have resulted in a need for an efficient means to control gas turbine exhaust emissions. The pollutants most generally of concern are CO, NOx, SOx, unburned hydrocarbons, soot. The present invention deals with such pollutants as unburned carbon, soot and other particulate emissions as well as pollutant gases.

2. Description of the Prior Art

Exhaust gas after-treatment in vehicles is well known in the art and is commonly used to meet emission requirements. Current after-treatment is used to remove unwanted nitrogen and sulfur compounds as well as particulate matter. In diesel systems electrostatic collectors have been used to remove suspended particulate matter including oil droplets from the blow-by gas, for example, so that blow-by gas can be returned to the atmosphere or to the fresh air intake side of the diesel engine for further combustion. Also, there are numerous applications that require ultra-filtering including the removal of sub-micron and nano-particles.

For example, the use of fossil fuel in gas turbine engines results in the combustion products consisting of carbon dioxide, water vapor, oxides of nitrogen, carbon monoxide, unburned hydrocarbons, oxides of sulfur and particulates. Of these products, carbon dioxide and water vapor are generally not considered objectionable at least as pollutants. In most applications, governmental imposed regulations are further restricting the remainder of the constituents emitted in the exhaust gases. The majority of the products of combustion emitted in the exhaust can be controlled by design modifications, cleanup of exhaust gases and/or regulating the quality of fuel used. For example, sulfur oxides are normally controlled by the selection of fuels that are low in total sulfur. This leaves nitrogen oxides, carbon monoxide and unburned hydrocarbons as the emissions of primary concern in the exhaust gases emitted from the gas turbine or an automotive engine. Particulates in the engine exhaust have been controlled either by design modifications to the combustors and fuel injectors or by removing them by traps and filters.

In general, combined cycle gas turbines are better candidates for emissions control than simple cycle units. The main challenge in a combined cycle system is to find enough space to house the emissions control unit within the Heat Recovery Steam Generator (HRSG) in the proper temperature regime. Depending on the exhaust temperatures, simple cycle gas turbines present somewhat more complicated challenge The lower exhaust temperature of some mature frame gas turbines, which is usually well below 450° C. (842° F.) is within the operating capability of conventional technologies and materials. In a simple cycle gas turbine configuration, the emissions control system is normally located immediately downstream of the gas turbine and requires an expansion from the gas turbine outlet exhaust duct to the emissions control system.

Electrostatic collectors and particulate filters are also known in the art. In some of my previous patents, I teach systems containing these components. (Krigmont—U.S. Pat. Nos. 6,932,857; 6,524,369; 5,547,493) used to clean flue gas in power plants. U.S. Pat. Nos. 6,932,857, 6,524,369 and 5,547,493 are hereby incorporated by reference. In addition, Chang in U.S. Pat. No. 7,267,712 teaches picking up charged particles in an electric field, while others (U.S. 2005/925170, US2006/524369, U.S. 2005/322550 and U.S. 2005/492557) teach various electrostatic air cleaners.

Prior art systems are many times large and expensive and do not necessarily provide the type of filtering needed for vehicle or portable applications. It would be advantageous to have a compact, space-efficient hybrid collector that uses corona discharge to charge particles and partially collect them and the combination of porous surfaces and uniform electric fields to collect the remaining particles for use in an automotive or other vehicle exhaust emissions control system, combustion turbines or for any other space-restricted or portable use including high technology uses such as surgery and semiconductor manufacture where it is important to trap sub-micron particles. It would also be advantageous to optionally use barrier filters known in the art to convert hazardous compounds into more benign substances.

SUMMARY OF THE INVENTION

The present invention relates to a compact, hybrid collector that overcomes the deficiencies of the prior art that can be used in a vehicle emissions control system or in any other application where space and lower cost is important. According to the principles of the present invention, exhaust gas enters the device and is immediately exposed in a first zone to a high-tension corona discharge electric field which results in a strong ionic flow by charging the incoming effluent (oil mist, soot particles, etc.). Charged particulate begins to migrate (follow the high-tension electric field) towards the collecting electrode where it settles and retained until it is removed by any conventional means. Subsequently, the charged flow enters a second zone of high-tension uniform electric field that causes the charged particles to migrate to one of the charged electrodes. One of the electrodes can be made of porous filter material that allows the cleaned gas to flow into an exit zone also containing a high-tension uniform electric field where the remaining effluent is collected prior to the clean gas exiting either to ambient air, or being re-circulated to be used again by an engine. In some embodiments a dielectric barrier discharge surface can be provided to convert harmful compounds to more desirable substances. Separately, the porous dielectric surface can be also made catalytically active to convert harmful constituents into less toxic substances.

DESCRIPTION OF THE FIGURES

Attention is directed to figures that can aid in understanding the present invention.

Several drawings and illustrations have been presented to aid in understanding the present invention. The scope of the present invention is not limited to what is shown in the figures.

DESCRIPTION OF THE INVENTION

The present invention relates to a compact, space-efficient hybrid collector for use in a vehicle exhaust system or in any other application where price and compactness are important. The invention is hybrid in the sense that it combines electrostatic collection with particulate filters made of porous materials. The requirements for a space-efficient filter that could be used in a vehicle exhaust system are high filtration efficiency, no secondary emissions, high durability, low maintenance costs at intervals within steps of vehicle inspection as well as limited increase in weight and low back-pressure. Similar requirements are also could can also be applied to combustion turbines and clean air applications.

The present invention can provide a compact, space-efficient hybrid collector that improves utilization of space within a unique assembly allowing for a reduction in assembly size or an increase in flow rating for the same package size.

Figure 1:
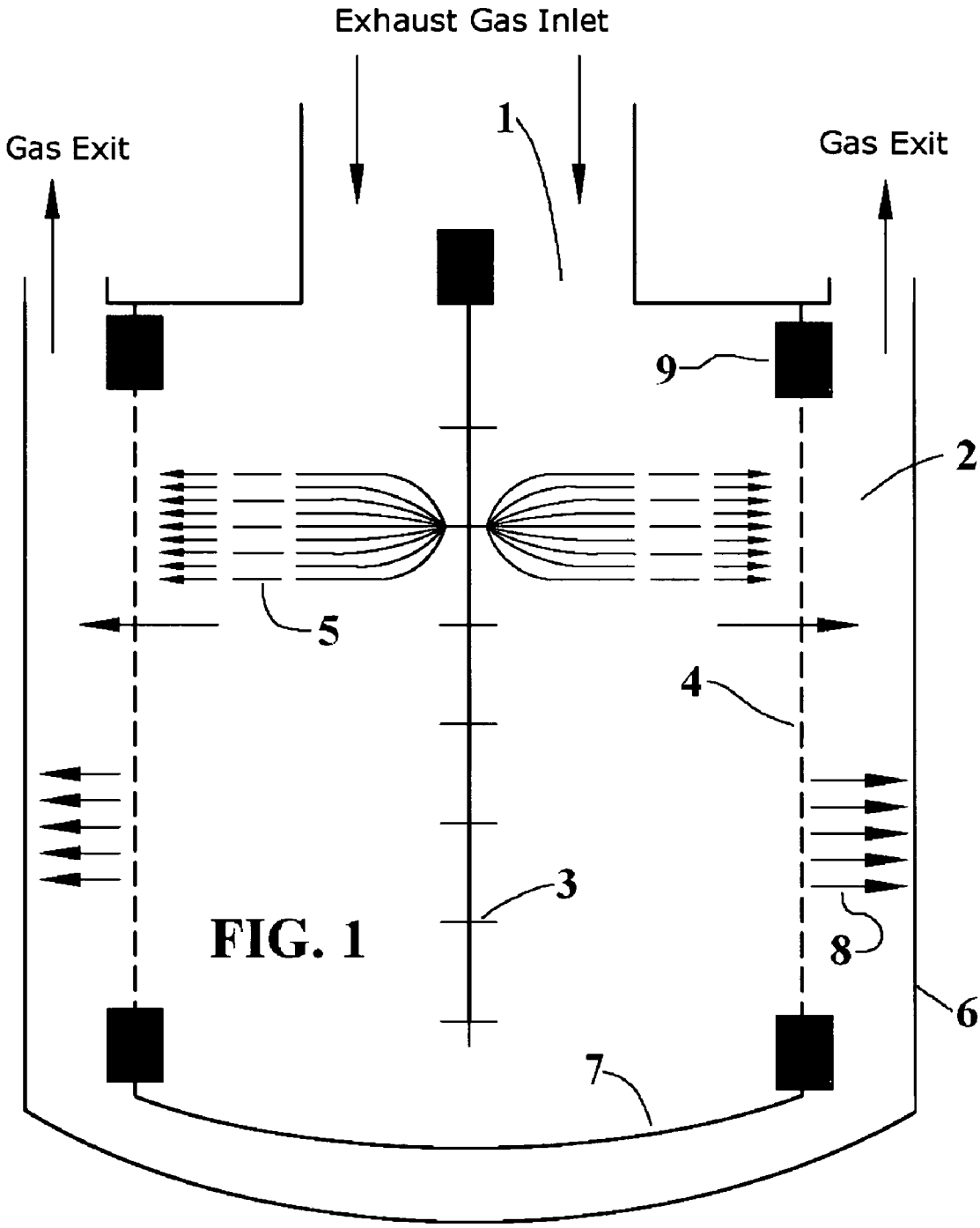
FIG. 1 shows a first embodiment of a hybrid collector where the barrier filter is used as an electrode for both the corona discharge and the uniform electric field.

Turning to FIG. 1 a first embodiment of the present invention is shown. An inner container with a bottom 7 and a porous surface 4, preferably circular or oval in cross-section can be contained in an outer, possibly metal or other material container 6. A porous cylindrical surface 4 is connected to insulators 9. Gas flows into the device through a gas inlet (top) into a first region 1 where it immediately encounters a high-tension corona discharge 5 emitted from a series of discharge points 3 located on an insulated axially centered electrode. The corona discharge 5 is between the discharge points 3 and the porous surface 4. The discharge points 3 can be grounded or maintained at any convenient potential with respect to the porous surface 4. A high-tension potential is placed on the porous surface 4 with respect to the outer container 6 so that a region of uniform high intensity electric field is formed between the concentric cylindrical porous filter 4 and the outer container 6 (which is grounded to the vehicle frame in the case of a vehicle system).

As previously explained, particles and droplets in the incoming flow stream immediately encounter the corona discharge 5 and become charged. As the charged particles continue in the high-tension corona discharge 5, they begin to follow the electrical field towards the porous collecting electrode 4, which being charged opposite to the particulate, attracts and collects many of them. As the flow passes through the porous medium, some remaining particles are collected by the porous filter 4. On the other side of the porous surface 4, the flow emerges into an outer chamber 2 and region of uniform electric field 8. The previously charged remaining particles are typically accelerated along field lines until they reach one of the surfaces where they remain. It can be seen in this embodiment that the flow direction is reversed 180 degrees in the uniform field region. This allows the gas move back the entire length of the device in the uniform field region allowing maximum exposure time for particulate capture.

Figure 2:
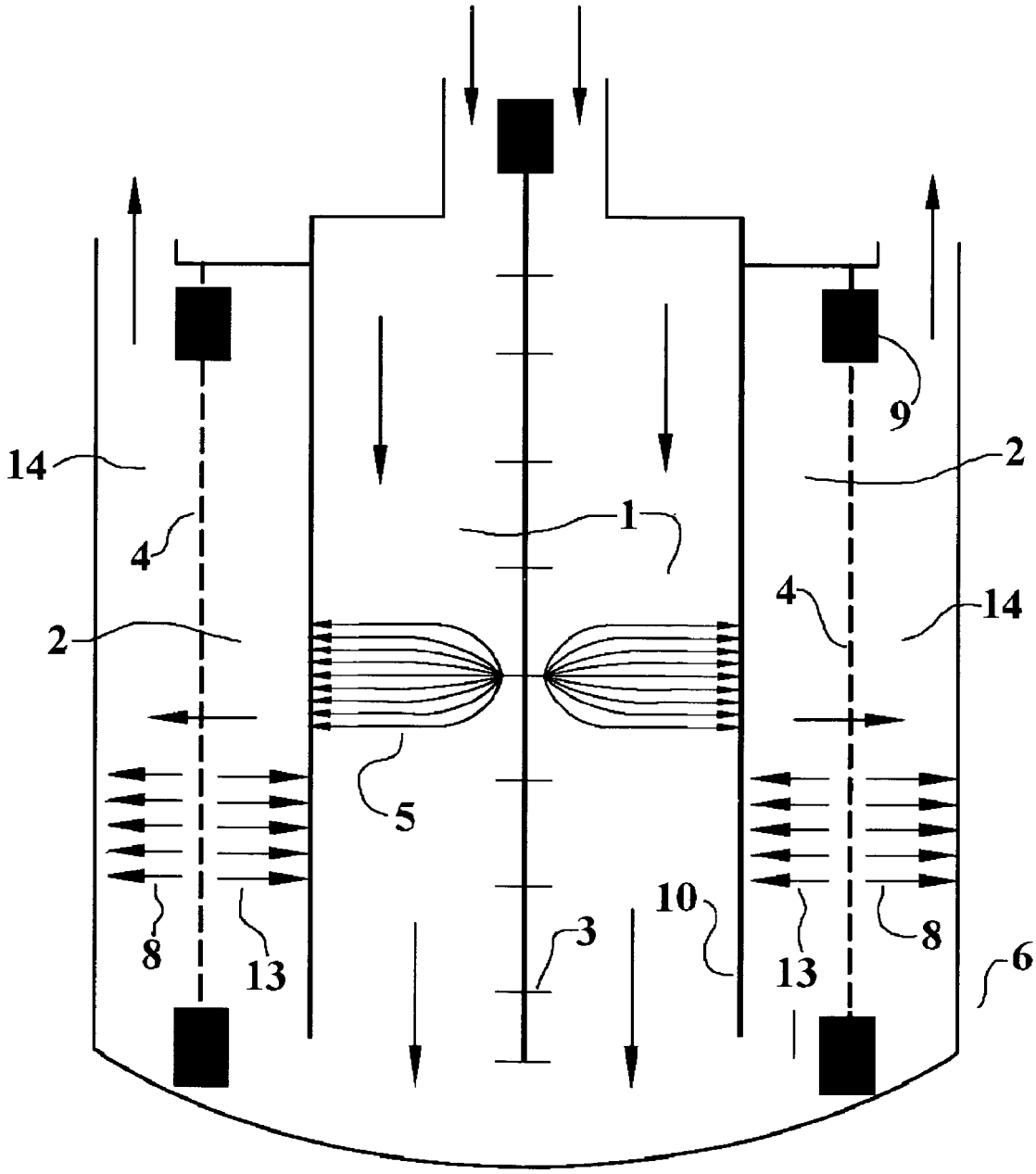
FIG. 2 shows a second embodiment of a hybrid collector where the barrier filter is used as an electrode for two separate regions of uniform electric fields.

FIG. 2 shows a second or alternate embodiment of the present invention that uses a grounded metal section 10 and an ungrounded (high-tension) axial center section with discharge points 3. Gas flow typically enters the first stage 1 and immediately encounters the corona discharge 5. Gases can then pass out of the bottom of this first region 10 and into a second region 2 that is divided by a cylindrical porous surface 4. In this embodiment, the gas flow normally enters into the inner compartment 1 where it passes through regions 5 of corona discharge. It then is typically routed by the structure into a region 2 of uniform electric field 13. From here, it can pass through a porous surface 4 and enter a second region 14 of uniform electric field 8. While the uniform electric fields 8, 13 in the two regions 2, 14 are normally the same or similar, they can also be different. It is within the scope of the present invention to use uniform fields of any field strength or configuration. The porous surface 4 is normally insulated with insulators 9 and raised to a high potential with respect to the rest of the device.

The flow on both sides of the porous surface 4 is typically subjected to two high-tension uniform electric fields. This normally causes charged particles on both side of the porous filter 4 to be captured. The gas with particulate matter enters the first zone 1, where the particulate immediately charges, and some of it becomes trapped by the grounded collecting surface 10; the remaining uncollected particles still in the gas enter the first zone with the high-tension uniform discharge 13 where a portion of the charge particulate also gets collected on either porous collecting surface 4 or the outer surface of the cylindrical grounded electrode 10. Following this, the gas can pass through the porous wall 4 (barrier filtration) to the next zone which also contains a uniform field 8. It is in this field that the final cleanup typically takes place. In the case of the embodiment shown in FIG. 2, the exit is on the same end of the device as the inlet.

Figure 3:
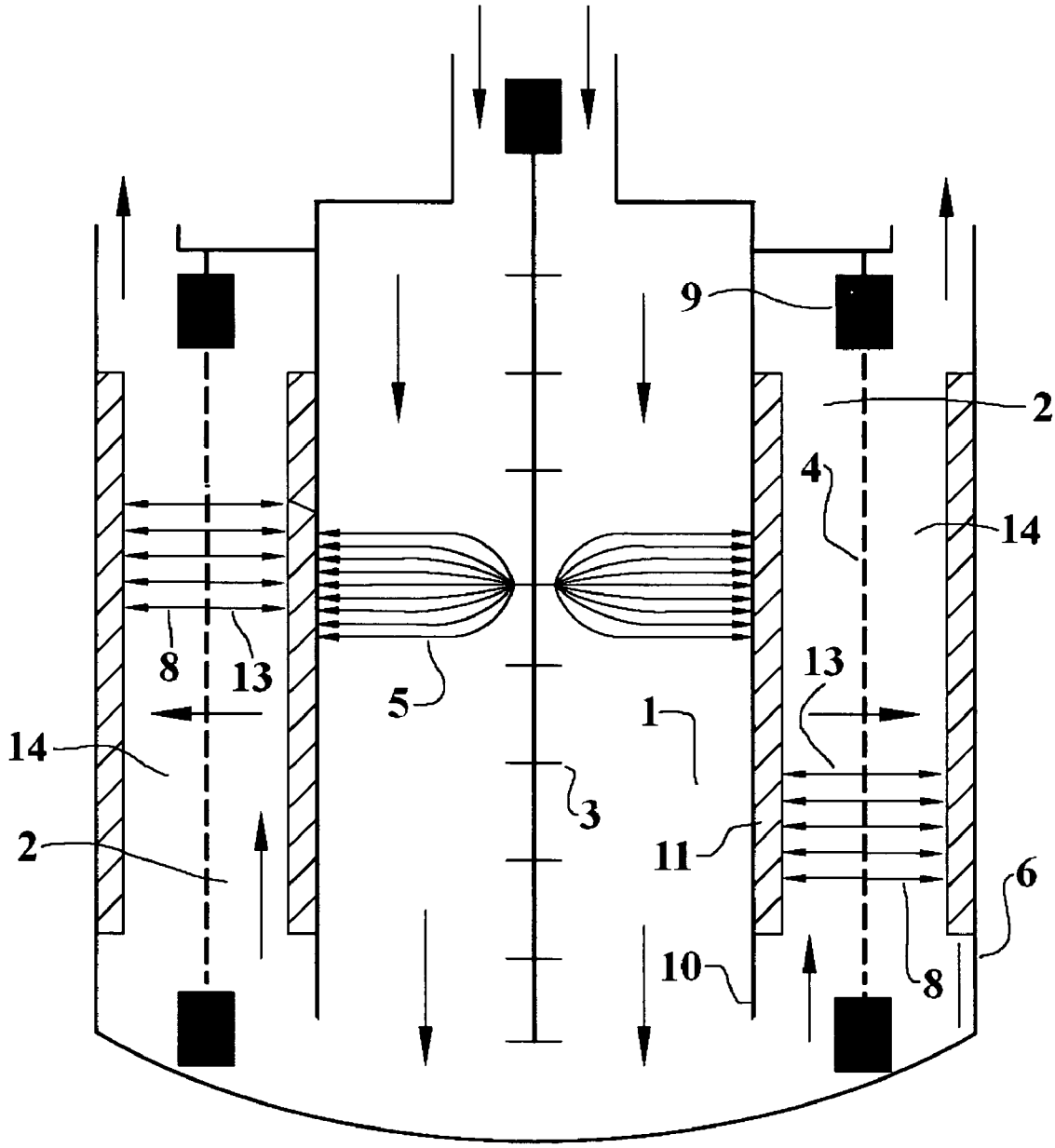
FIG. 3 shows a third embodiment that uses a dielectric layer in the regions of uniform electric fields.

FIG. 3 shows a variation of the embodiment of FIG. 2 where the inner surfaces of regions 2 and 14 are covered with a dielectric layer 11 or plates/covers. This dielectric layer can create a barrier discharge region known in the art to be able to chemically convert hazardous gases to less harmful molecules. It should be noted that this type of a barrier discharge surface can be used with any of the embodiments of the present invention. The barrier discharge is just an example of a possible process on this surface.

Figure 4A:
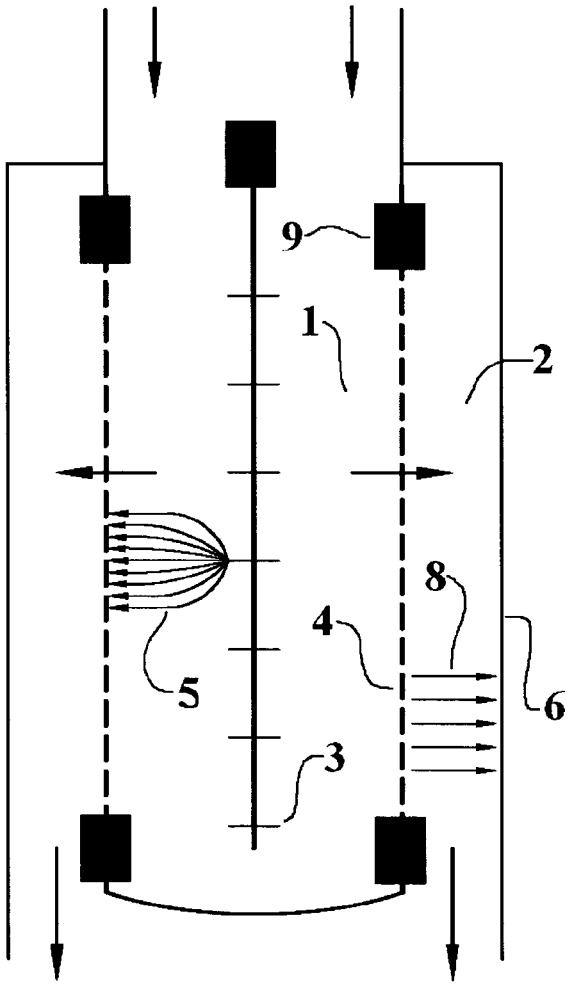
FIG. 4*a* shows a narrower embodiment that uses a possibly coated porous electrode.
Figure 4B:
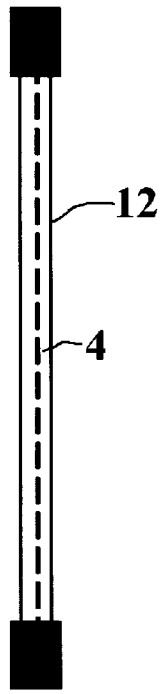
FIG. 4*b* shows an isolated view of a coated porous electrode.
Figure 5:
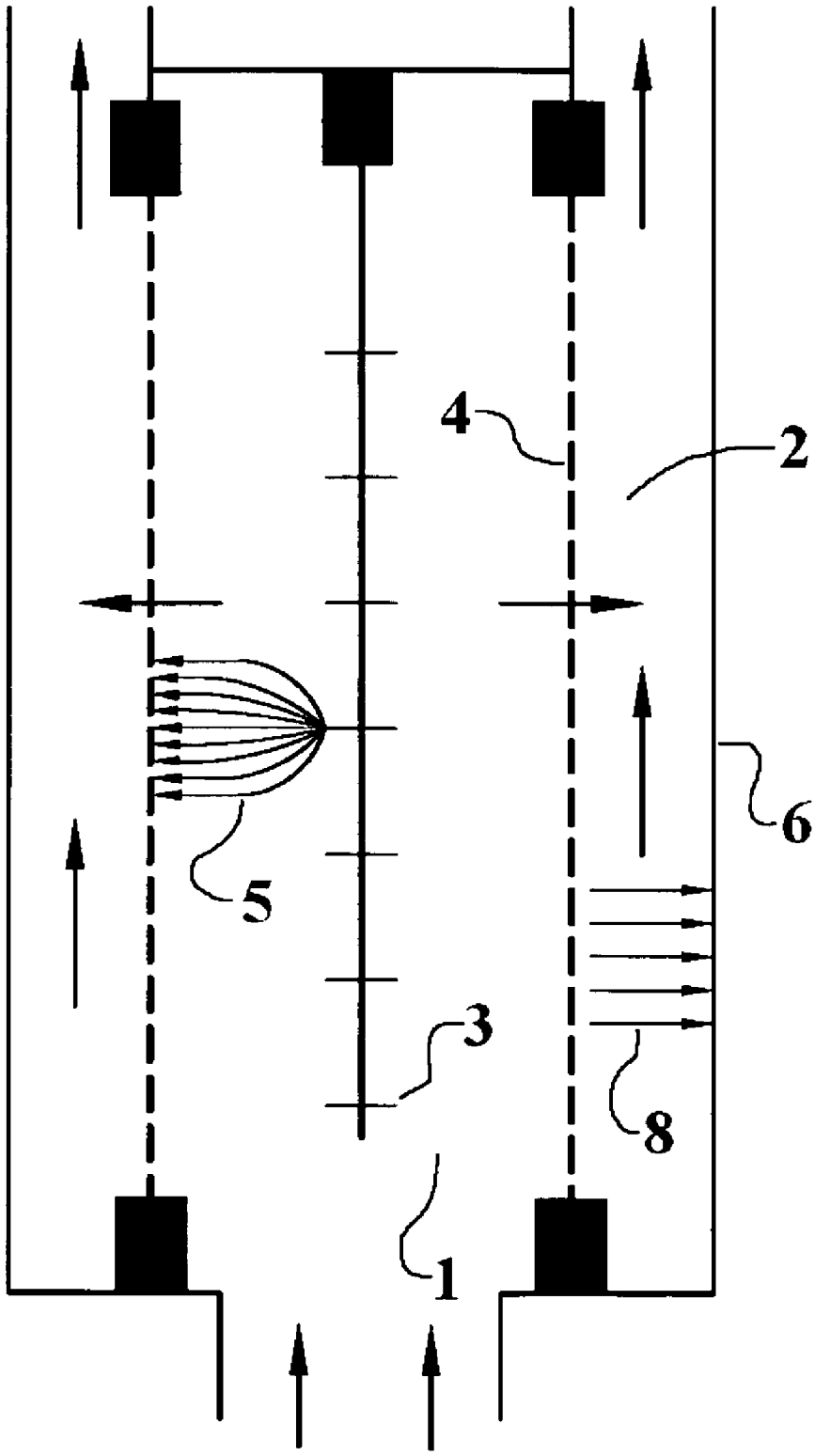
FIG. 5 shows a variation on the embodiment of FIG. 4.

FIGS. 4*a* and 5 show other versions of the present invention that operate very similarly to the embodiment of FIG. 1 except that they are flow-through in that the flow does not reverse direction after passing through the porous surface 4. Both of these embodiments use two regions 1, 2 separated by the porous surface 4. The inner region 1 subjects the flow to a corona discharge 5, and the outer region 2 subjects the flow to a uniform electric field 8. The porous surface 4 can be coated to promote chemical activity. FIG. 4*b* shows a view of a coated porous surface 4. The chemical coating 12 can be a catalyst applied as a wash coat by submerging the porous surface in it, or it can be applied by any other method. In particular, this catalytic surface can convert harmful gases such as nitrogen or sulfur compounds in the presence, for example ammonia, into less harmful substances or into substances that are easily collected. The catalytic material can be based on vanadium pentoxide or other catalytically active material with respect to NOx, CO or other gaseous pollutants. This technique is especially attractive for combustion gas and gas turbines where the gas flow is hot enough to activate the catalyst. In some instances, addition of ammonia known in the art to promote catalytic reaction may be optionally used.

It should be noted in the various embodiments, that while a cylindrical embodiment is preferred, especially for vehicle applications, any of the embodiments could be used with an oval, rectangular, hexagonal or octagonal cross-section or any other cross-section. The devices can also be packaged conveniently using outer protective layers if necessary to prevent corrosion and with fittings to provide for easy mounting. The devices can be metal, plastic, ceramic or any other suitable material. Any cross-section or packaging is within the scope of the present invention as well as any material that is strong and can withstand high temperatures. Combinations of various materials such as ceramic and plastic may also be used. Any of the embodiments of the present invention can be operated using either AC or DC voltages and at various different potentials known in the art. In the case of a vehicle, the potential can be supplied by a high voltage generator that is powered from the vehicle's battery.

Figure 6:
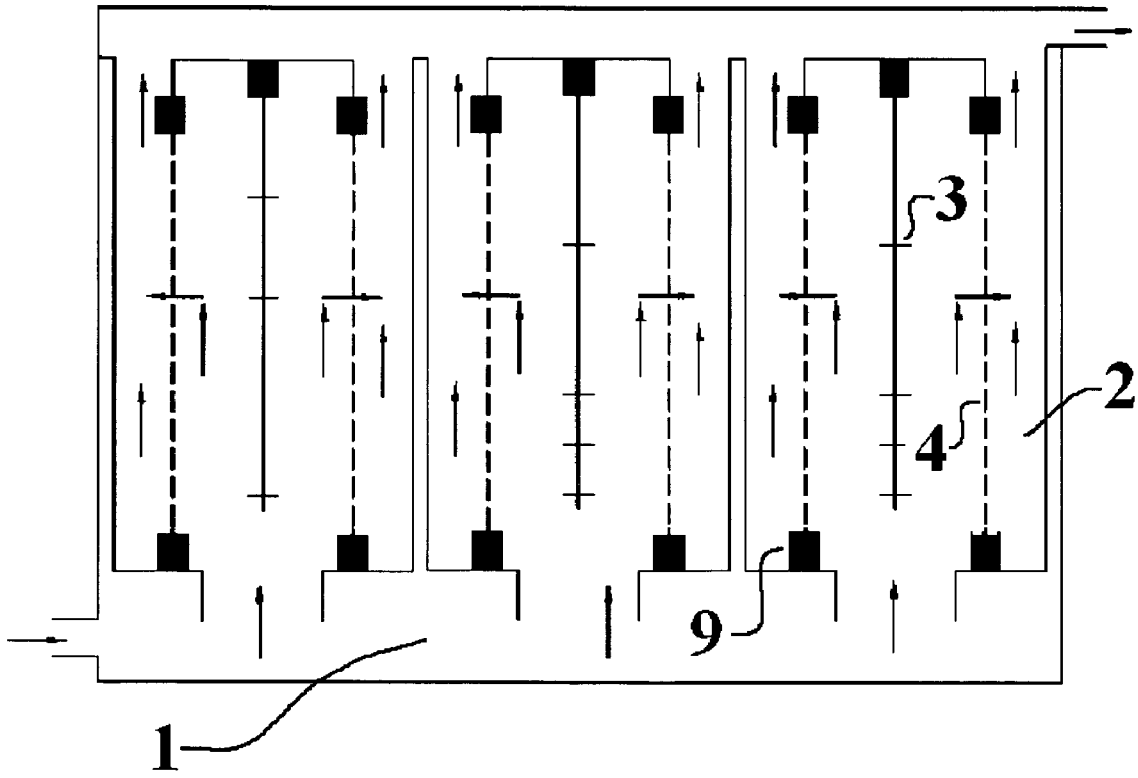
FIG. 6 shows a repeating multi-zone embodiment.

FIG. 6 shows an embodiment of the invention that uses a multi-unit parallel approach to allow for the treatment of larger gas volumes. This embodiment is particularly useful in applications involving combustion or gas turbines. Gas enters through an entrance into region 1 and can pass through one of several different corona discharge areas where corona is initiated from corona electrodes 3. In each parallel section, gas can pass through a porous surface 4 and into a region of constant electric field 2 before exiting the device. All of the modifications discussed in previous embodiments such as coated surfaces, barrier discharge regions and multiple regions of uniform field can be used the a parallel arrangement similar to the embodiment shown in FIG. 6.

Figure 7:
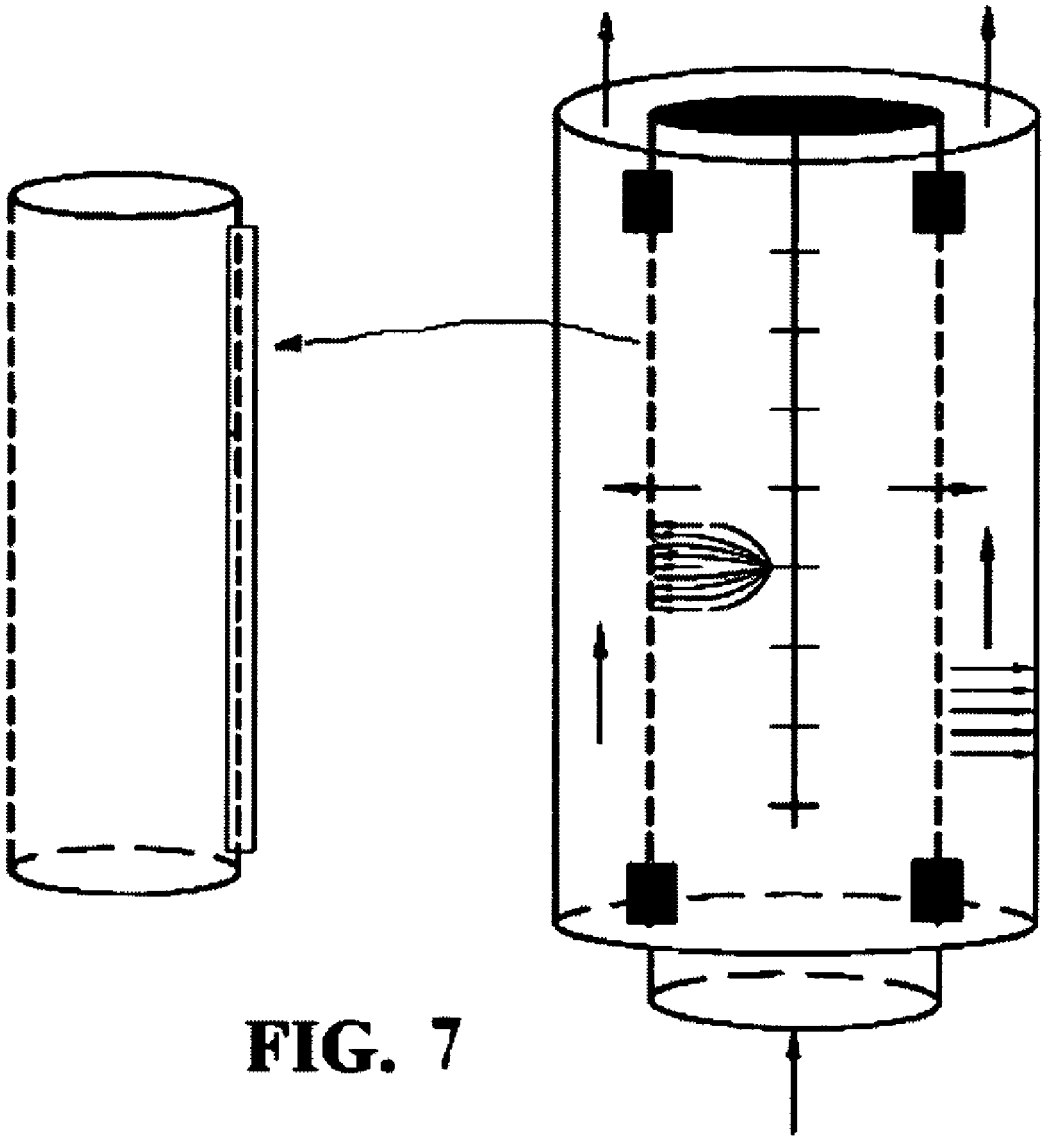
FIG. 7 is a perspective view of the embodiment of FIGS. 4*a* and 4*b*.
Figure 8:
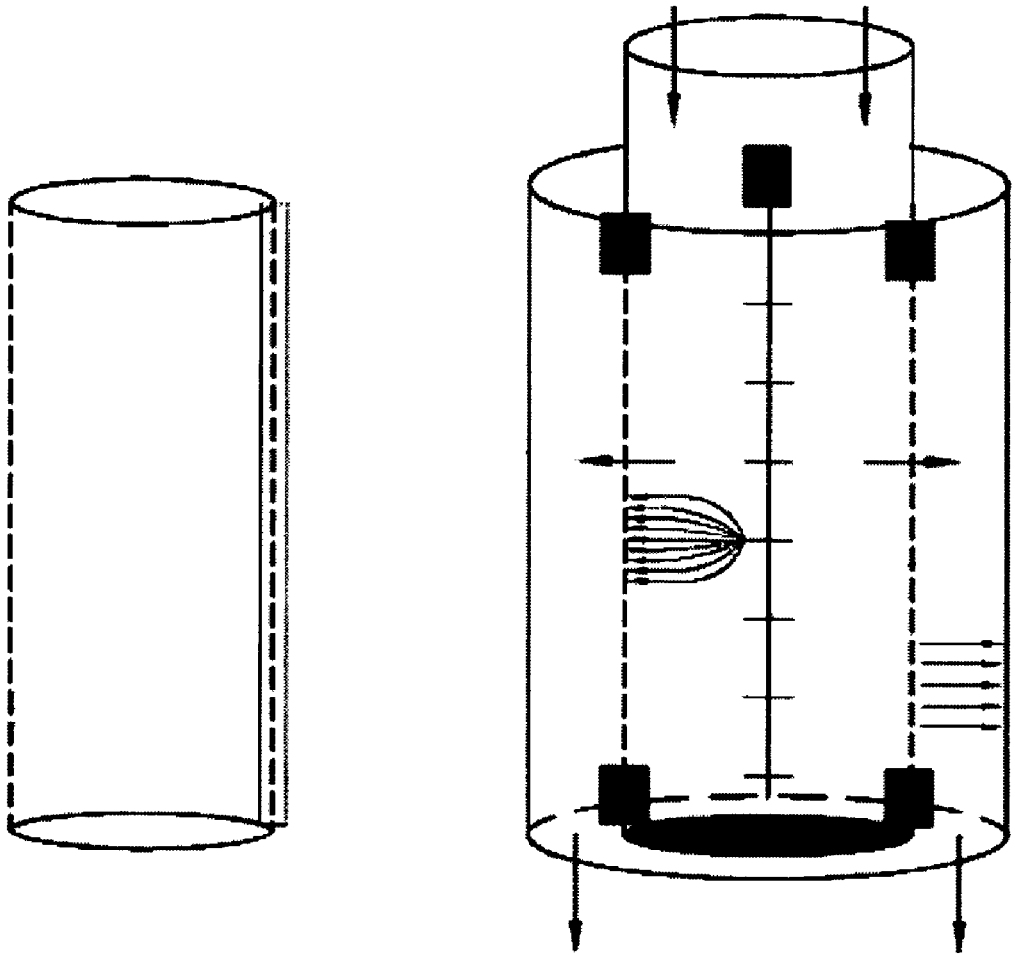
FIG. 8 is a perspective view of the embodiment of FIG. 5.

FIG. 7 shows a perspective view of the embodiment of FIGS. 4*a*-4*b*, and FIG. 8 shows a perspective view of the embodiment of FIG. 5.

Several descriptions and illustrations have been provided to aid in the understanding of the present invention. One with skill in the art will realize that numerous changes and variations are possible without departing from the spirit of the invention. Each of these changes and variations is within the scope of the present invention.

I claim:

1. A compact hybrid collector system comprising:

a first region containing a high-tension corona discharge;

a second region separated from said first region containing a first high-tension substantially constant electric field;

a third region separated from said second region by a porous surface, said third region containing a second high-tension substantially uniform electric field;

wherein gas flow enters said first region where particles in said gas flow become charged by said corona discharge; and wherein said gas flow enters said second region where particles in said gas are removed by said first high-tension electric field, and wherein said gas flow passes through said porous surface into said third region where particles are removed by said second high-tension electric field.

2. The compact hybrid collector system of claim 1 wherein said porous surface is coated with a catalyst.

3. The compact hybrid collector system of claim 1 wherein said first, second and third regions are cylindrically shaped.

4. The compact hybrid collector system of claim 1 further comprising a central electrode with discharge points for forming said corona discharge.

5. The compact hybrid collector system of claim 1 wherein said central electrode is grounded.

6. The compact hybrid collector system of claim 5 wherein said porous surface is raised to a high electric potential with respect to said central electrode.

7. The compact hybrid collector system of claim 1 further comprising an enclosure containing said system made of a material selected from the group consisting of metal, plastic and ceramic.

8. The compact hybrid collector system of claim 1 further comprising a dielectric barrier discharge in said second region.

9. The compact hybrid collector system of claim 1 further comprising a plurality of first and second regions operated in parallel.

10. A hybrid collector system comprising a first region where a gas flow passes through a plurality of corona discharges, a second region where said gas flow passes through a first substantially uniform electric field and a third region where said gas flow passes through a second substantially uniform electric field, and wherein said second and third regions are separated by a porous surface.

11. The hybrid collector system of claim 10 wherein said porous surface is coated with a catalyst.

12. The hybrid collector system of claim 10 further comprising a dielectric barrier discharge region in said second or third regions.

* * * * *